United States Patent [19]

Boissicat

[11] 4,234,418

[45] Nov. 18, 1980

[54] DIP-HANDLING APPARATUS

[75] Inventor: Claude M. Boissicat, Sunnyvale, Calif.

[73] Assignee: Contrel Corporation, Sunnyvale, Calif.

[21] Appl. No.: 918,609

[22] Filed: Jun. 23, 1978

[51] Int. Cl.[2] ..... B07C 5/344

[52] U.S. Cl. ..... 209/542; 209/545; 209/573; 209/909; 209/919; 221/266

[58] Field of Search ..... 209/538, 540, 542, 545, 209/571-575, 919, 909, 911, 933; 221/266, 265, 131; 222/368; 414/222-226; 198/403, 408, 409

[56] References Cited

U.S. PATENT DOCUMENTS

| | | | |
|---|---|---|---|
| 2,772,818 | 12/1956 | McLauchlan | 222/368 |
| 3,209,907 | 10/1965 | Wiesler et al. | 209/573 |
| 3,727,757 | 4/1973 | Boissicat | 209/573 |
| 3,896,935 | 7/1975 | Hjelle et al. | 209/573 |
| 4,128,174 | 12/1978 | Frisbie et al. | 209/573 |

FOREIGN PATENT DOCUMENTS

| | | | |
|---|---|---|---|
| 548911 | 3/1977 | U.S.S.R. | 209/573 |

*Primary Examiner*—Robert J. Spar
*Assistant Examiner*—Edward M. Wacyra
*Attorney, Agent, or Firm*—Claude A. S. Hamrick

[57] ABSTRACT

A DIP-handling apparatus comprising a support chassis, an input tray attached to the support chassis and including a plurality of DIP-receiving input trays arrayed in parallel, a reorienting and metering device for receiving a DIP from one of the tracks of the input tray, for reorienting the received DIP and for discharging the DIP onto a track leading to a test head station, an output tray attached to the support chassis, and a shuttle device for transporting the DIP from the test station to a particular track of the output tray as determined by the result of the tests performed at the test station.

20 Claims, 19 Drawing Figures

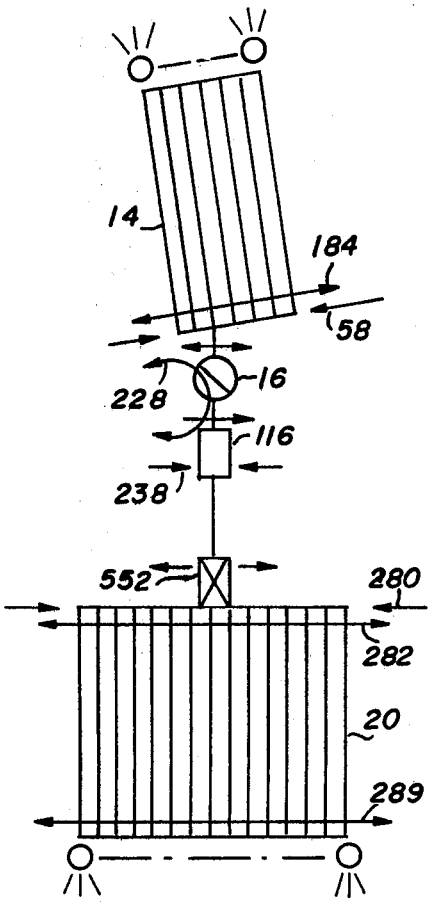
Fig_14
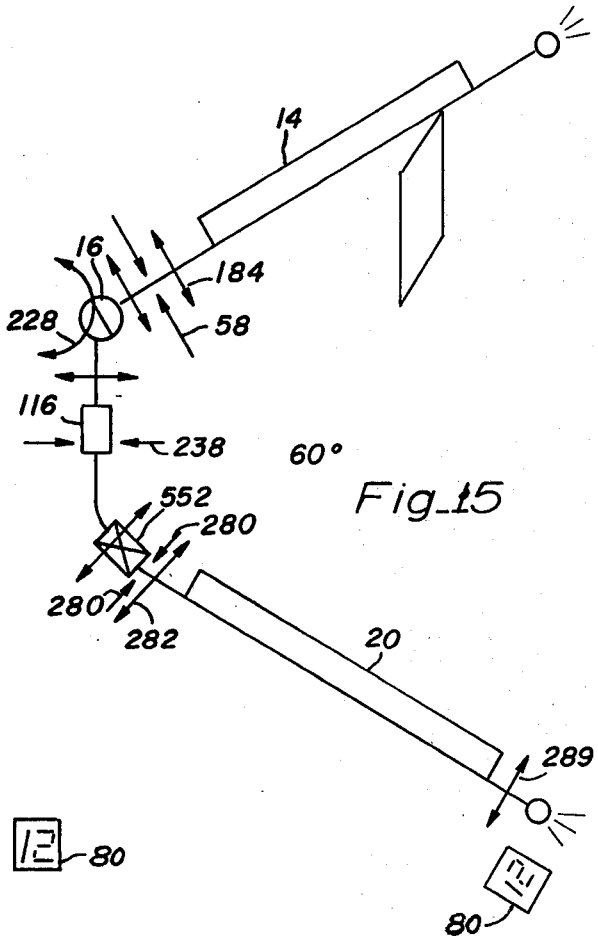
Fig_15
Fig_16
| SYMBOLOGY | | | |
|---|---|---|---|
| ←→ | PHOTOSENSING DEVICE(S) | ▥ | TRAY RESERVOIR |
| ⌒ | REFLECTOR IMPLEMENTED PHOTOSENSING DEVICE | →← | GATING DEVICE(S) |
| | | ⊘ | METER-REORIENTER |
| ○---○ | ROW OF VISIBLE LIGHT EMITTING DEVICES | ▭ | TESTING STATION |
| 12 | TWO DIGIT NUMERICAL DISPLAY | ⊠ | SHUTTLE |

DIP-HANDLING APPARATUS

BACKGROUND OF THE INVENTION

1. Field of the Invention

The present invention relates generally to an automated apparatus for handling large numbers of electronic components and more particularly to an apparatus for handling, testing and sorting dual in-line packed (DIP) integrated circuits.

2. Description of the Prior Art

DIP handlers, such as the one of this present invention, are devices for handling great numbers of DIPs in a regular and reliable manner. DIPs can thus be tested, marked and/or sorted in an automated, labor-saving, highly economical fashion.

When the handler is used to test and sort batches of DIPs, it is often desirable to perform these tests at above ambient temperatures. In this way, defects are more readily apparent because the DIP is being tested under simulated operating conditions. For this reason, DIP handlers often have a heated input tray to warm the DIPs to a predetermined temperature.

DIPs usually come in long tubes known as magazines. A magazine is an elongated hollow member having a substantially "A"-shaped saddle running down the center of the magazine. Pins or plugs are provided at either end of the magazine to prevent the DIPs from sliding out.

To be properly handled, it is necessary that the DIPs be discharged into the magazines from the output tray of the handler with the same orientation relative to the magazine that they had when they were discharged from the magazines into the input tray of the handler. In consequence, this means that if a magazine is used to load a number of DIPs into an input tray and a magazine is used to receive a number of tested and sorted DIPs from an output tray, the tested DIPs must be turned around or "reoriented" by the DIP handler somewhere between the input and the output tray. In the prior art this has been accomplished by a reorienter which receives a DIP from a metering device at the discharge end of an input tray and then pivots (usually downwardly) to discharge into the test station.

One problem with the reorienters of the prior art is that the DIPs have to be metered by a discrete device before reorientation can occur. Furthermore, for design considerations, the test head must be placed in an inaccessible position between the input and the output tray, making it difficult to interface the head with a tester.

The input tray of large capacity DIP handlers found in the prior art usually include a number of DIP-guiding tracks. In such systems, each of the tracks has an individual, solenoid-actuated gate which opens to discharge a DIP into a conveyor mechanism which meters and transports the DIPs to the reorienter. Such an arrangement is expensive and unreliable due to the multitude of mechanical or electro-mechanical parts necessary to implement it.

Applicant is aware of the following prior art:

U.S. Pat. No. 3,727,757 to Boissicat;

U.S. Pat. No. 3,655,041 to Baker; and

U.S. Pat. No. 3,198,330 to Weisler.

SUMMARY OF THE PRESENT INVENTION

An object of this invention is to provide a DIP-handling apparatus that is inexpensive, rugged and reliable.

Another object of this invention is to provide a DIP handler that can reliably handle DIPs at a higher speed than DIP handlers found in the prior art because of an improved gating system and an innovative reorienting and metering device.

Still another object of the present invention is to provide a DIP handler having improved DIP temperature control features.

Briefly, a presently preferred embodiment of the invention comprises a support chassis, an input tray for receiving DIPs in an upside down disposition and having a DIP-receiving end and a DIP-discharging end, means for attaching the input tray to the support chassis so that a particular one of a plurality of tracks formed along the upper surface of the input tray can be aligned with one end of a queueing track, metering and reorienting device disposed at the other end of the queueing track for inverting the DIP relative to the guide track reversing the DIP orientation and for metering one DIP at a time onto a guide track leading to a test head station where diagnostic tests are performed on the DIP, an output tray having a plurality of DIP-guiding and receiving tracks, and a shuttle device disposed between the test head station and the output tray for receiving a DIP discharged from the test station and for transporting and discharging the DIP into one of the plurality of sorting tracks of the output tray as determined by the results of the tests performed at the test station.

An advantage of the present invention is that the metering and reorienting device is a rotary member which can more efficiently and quickly invert, reorient and meter a DIP than can the reciprocating reorienter of the prior art.

Another advantage of the present invention is that my input tray need have only one actuator to operate all of the gates of the many tracks of the input tray.

Still another advantage of the present invention is that the DIPs can be loaded into the input tray in an upside down configuration so as to achieve better heading efficiency, yet are loaded into the output tray in an upright position to facilitate conventional handling.

These and other objects and advantages of the present invention will no doubt become apparent to those skilled in the art after having read the following detailed description which makes reference to the several figures of the drawing.

IN THE DRAWING

Figure 8:
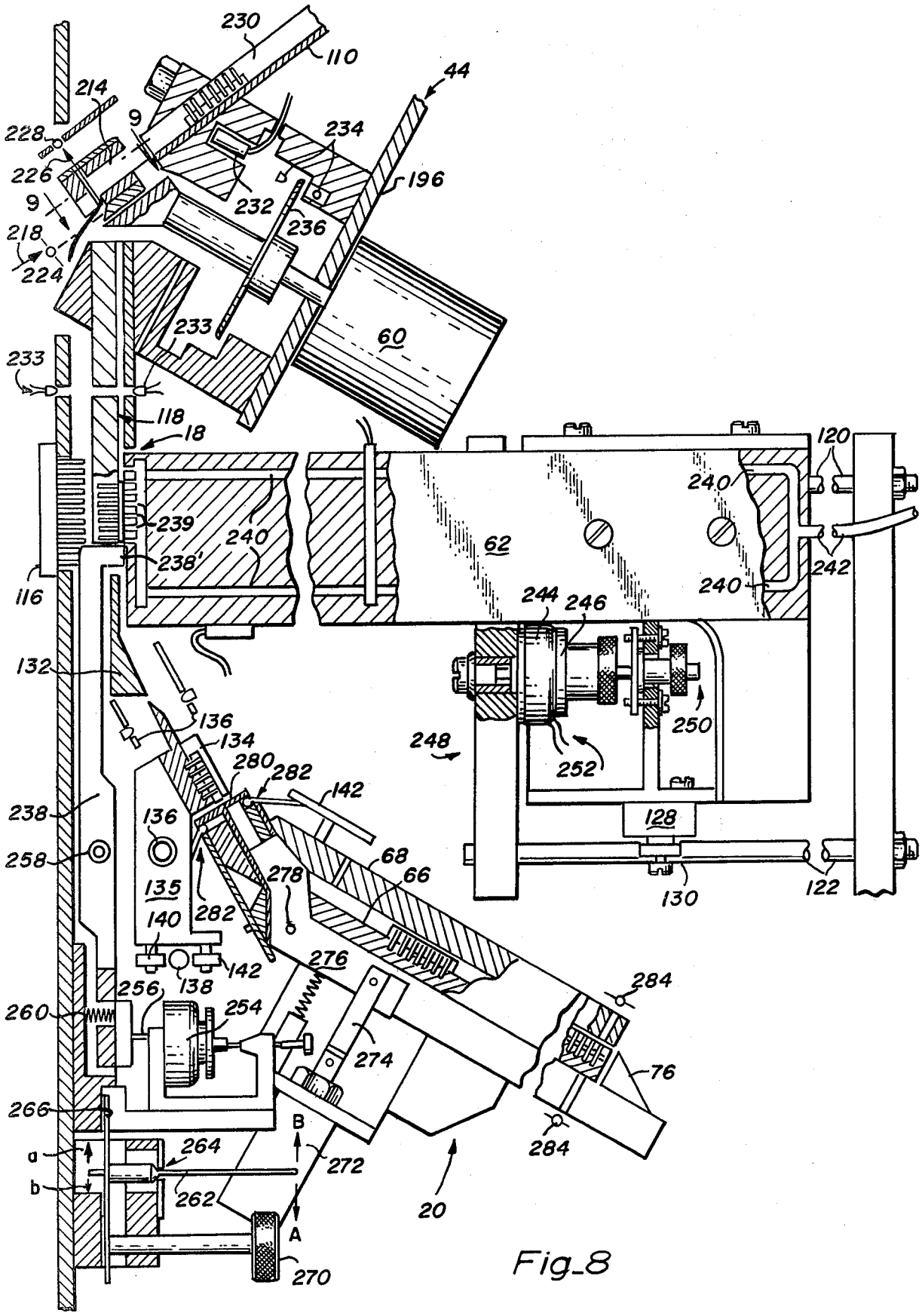
Figure 9:
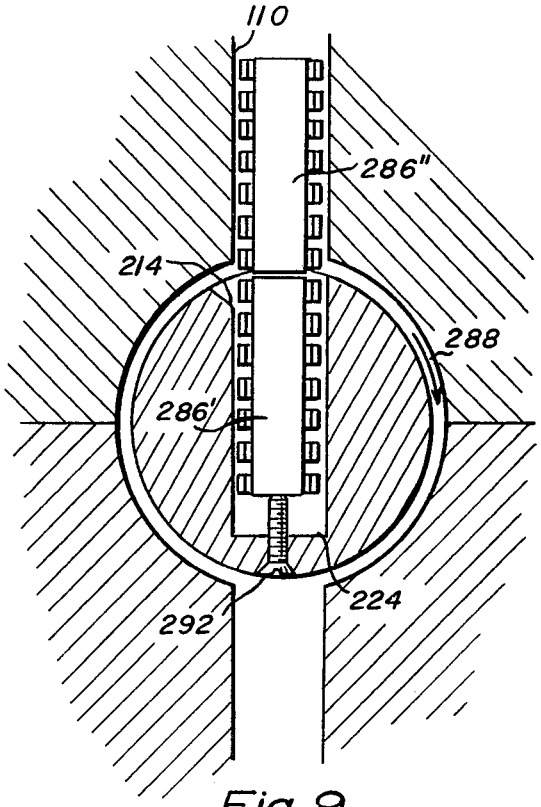
Figure 9A:
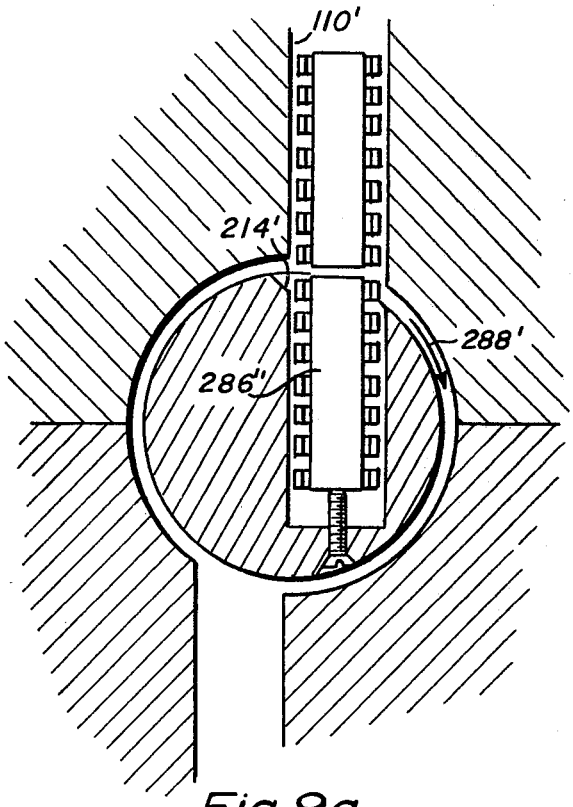
Figure 10:
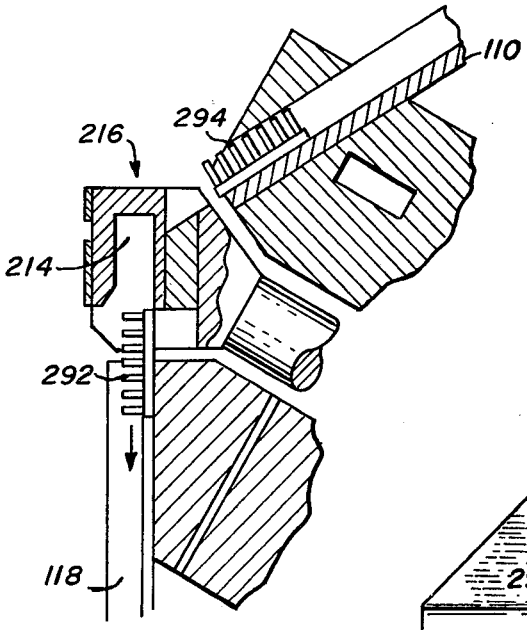
Figure 11A:
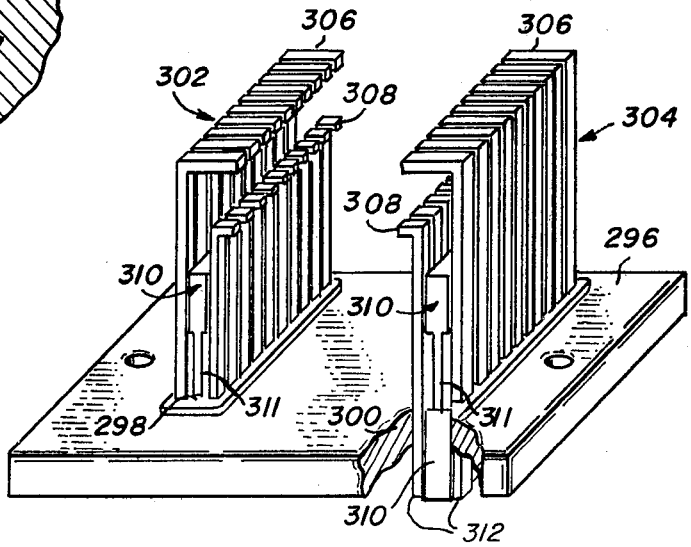
Figure 11B:
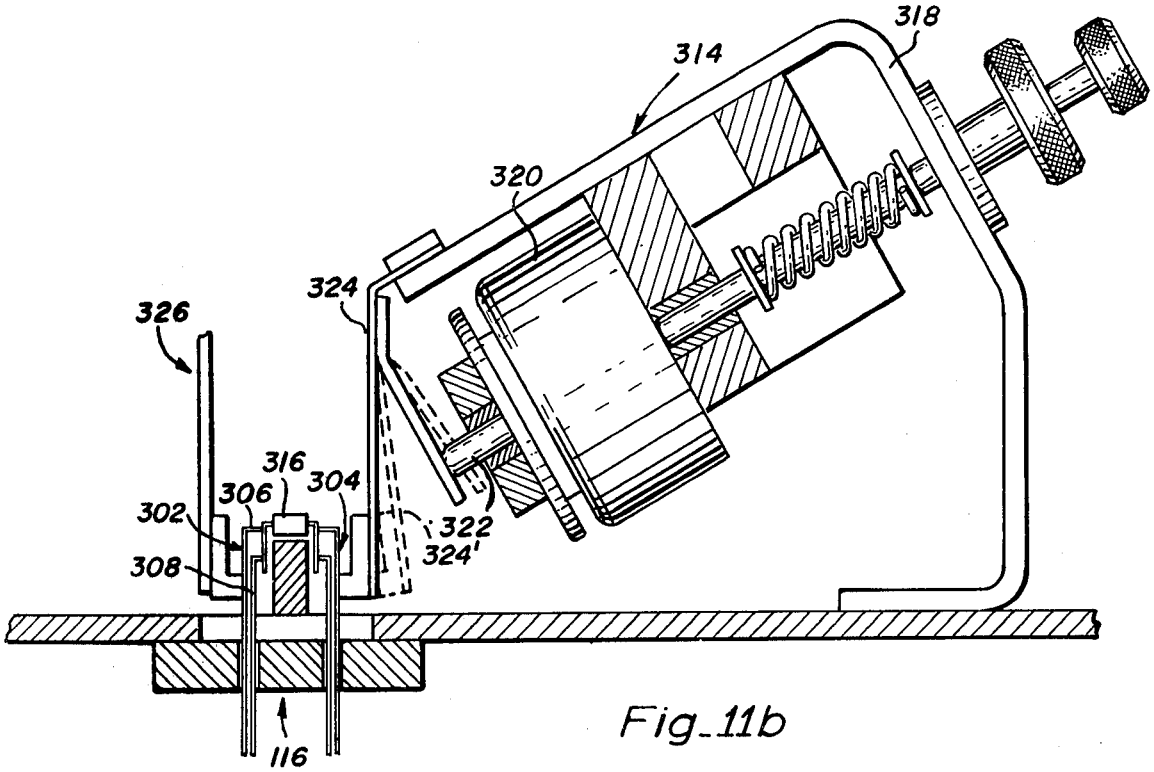
Figure 12:
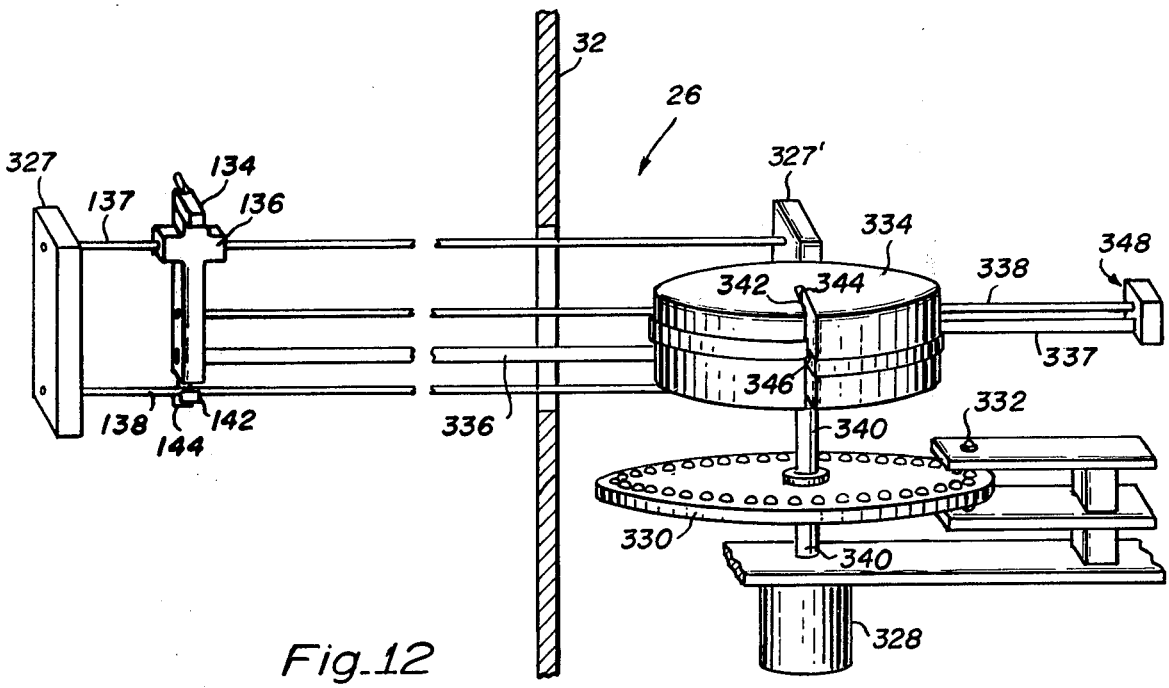
Figure 13:
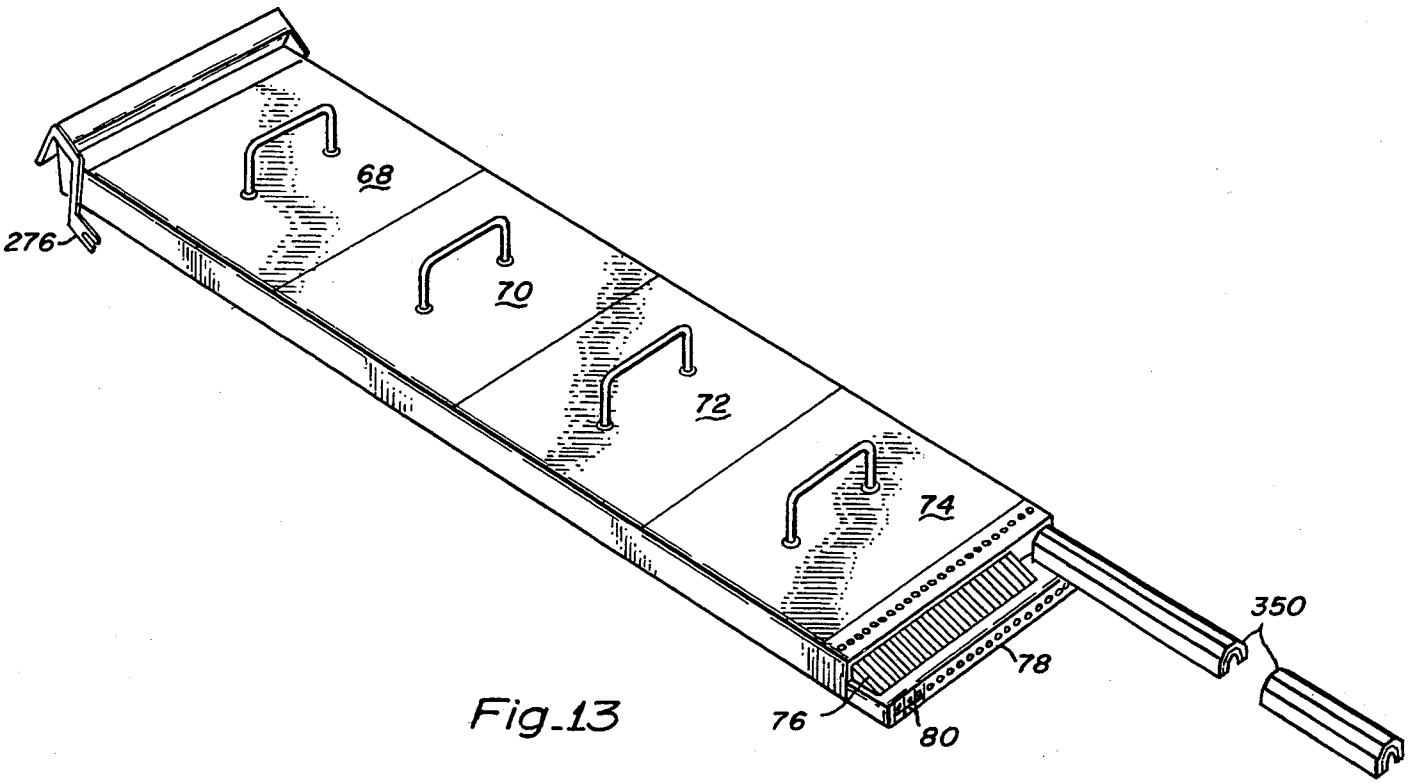

FIG. *7a* is a top plan schematic view of the input tray;

FIG. *7b* is a side elevational schematic view of the input tray;

FIG. *7c* is a partial schematic view of the input tray showing the roller bearing in two positions;

FIG. 8 is a partially broken side elevational view illustrating the path that a DIP would take between the input tray and the output tray;

FIG. 9*a* is a cross sectional view taken along line 9—9 of FIG. 8;

FIG. 9*b* is a cross sectional view of an alternate embodiment of a meter-reorienter in accordance with the present invention;

FIG. 10 illustrates the discharge position for the metering and reorienting device shown in FIG. 8;

FIG. 11*a* is a perspective view illustrating a test head as shown in FIG. 8;

FIG. 11*b* is a detail of the test head actuating solenoid assembly as shown in FIG. 8;

FIG. 12 is a perspective detail of the shuttle mechanism of the present invention;

FIG. 13 is a perspective view of the output tray;

FIGS. 14 and 15 are schematic representations of the functional components of my DIP-handling apparatus; and FIG. 16 is a table defining the symbols used in FIGS. 14 and 15.

DETAILED DESCRIPTION OF THE PREFERRED EMBODIMENT

Figure 1:
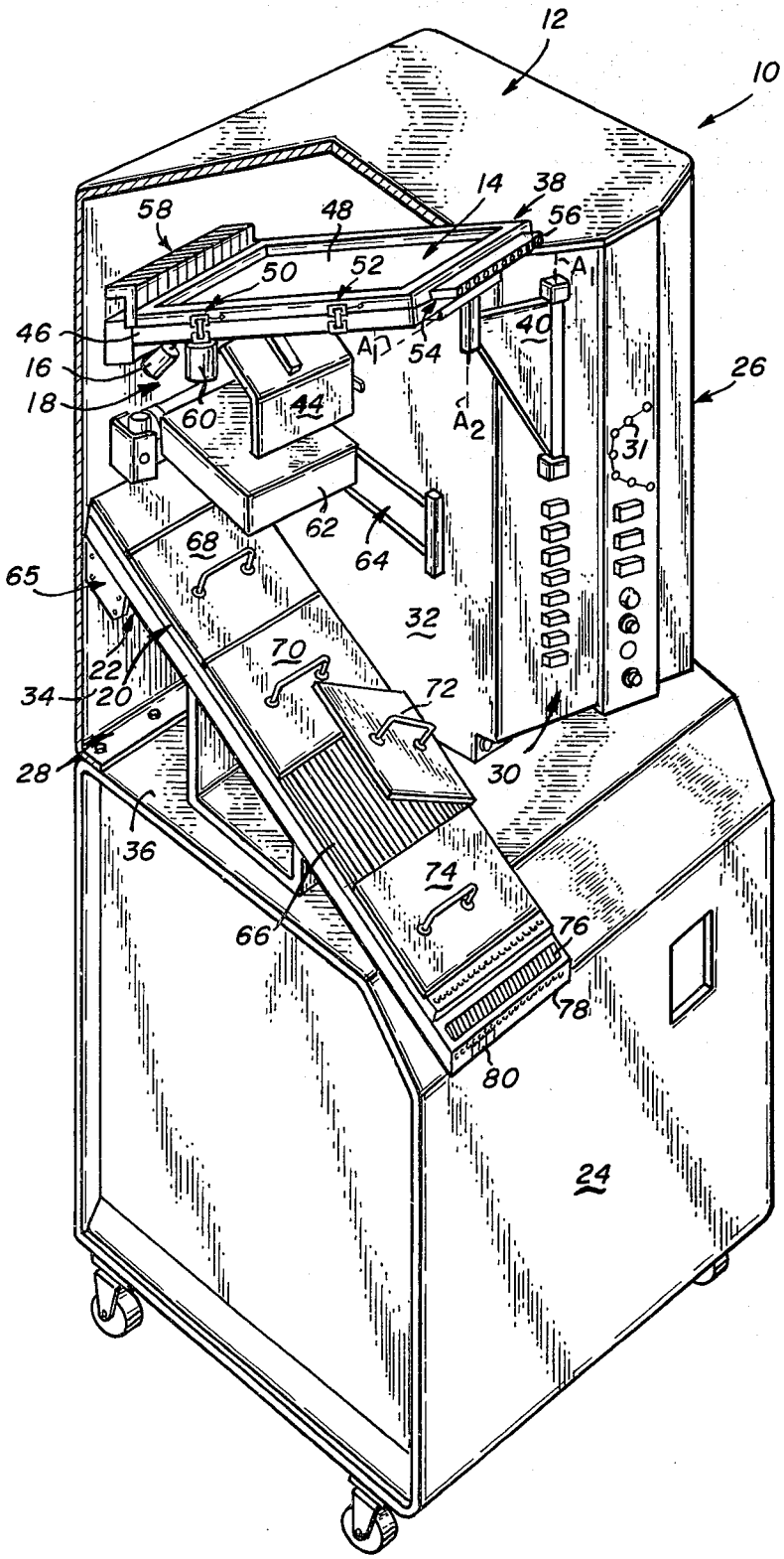
FIG. 1 is a perspective view of a DIP-handling apparatus in accordance with the present invention.
Figure 2:
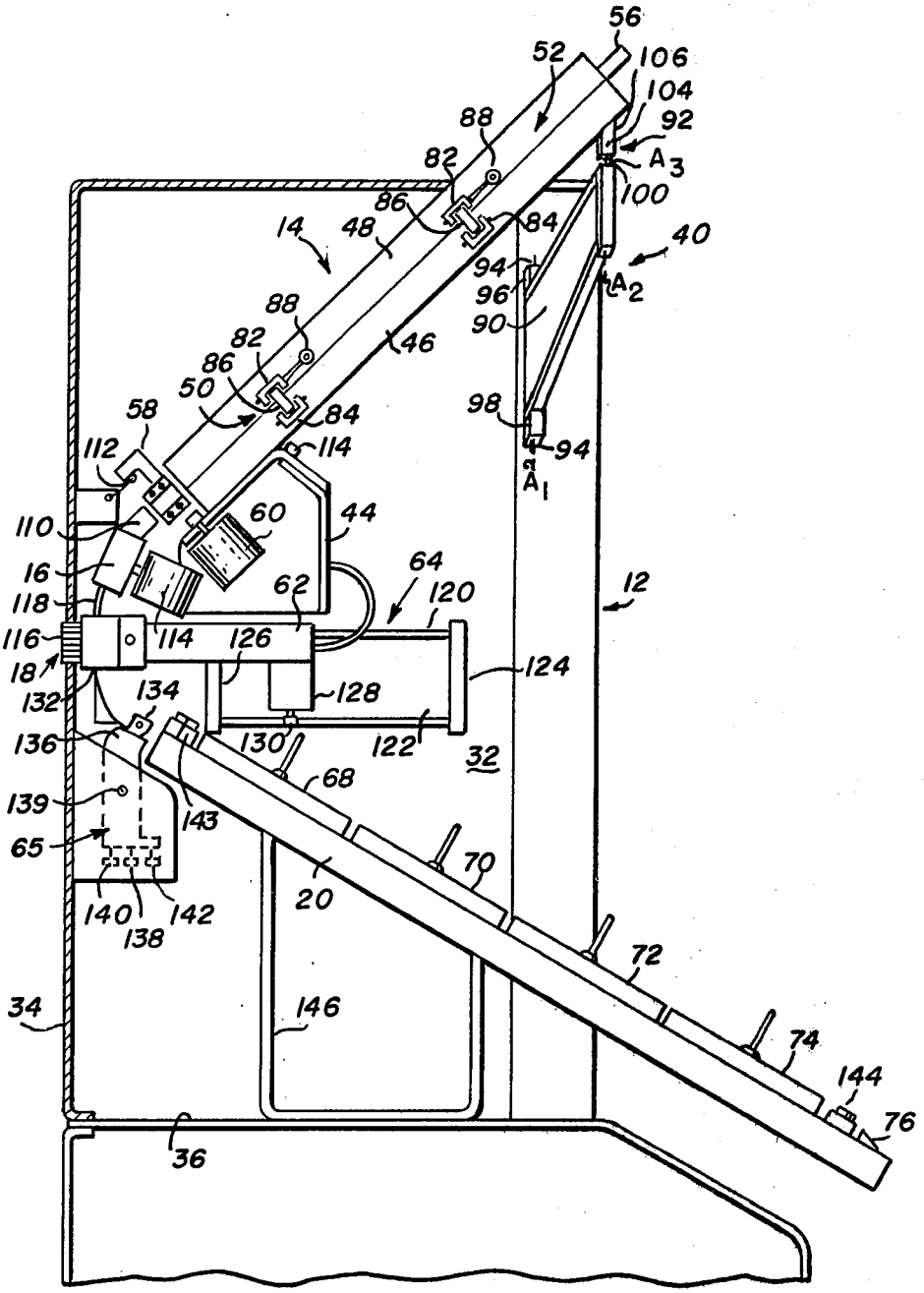
FIG. 2 is a partially broken side elevational view of the DIP handler shown in FIG. 1.

In FIG. 1 an improved DIP-handling apparatus 10 is shown to include a chassis 12, an input tray 14, a metering and reorienting device 16, a test head station 18, an output tray 20, and a shuttle mechanism 22 (see also FIG. 2).

Support chassis 12 is a unitized structure having a power supply cabinet portion 24, an electronic control cabinet portion 26 and a handling mechanism area 28.

Power supply portion 24 houses a heavy-duty power supply to supply current at the needed voltage to electric, electromechanical and electronic components of both the control portion and the handling area. Electronic control portion 26 includes the control logic computers for controlling the operational sequence of the various members of the handling mechanism.

Disposed on the front surface of the cabinet portion 26 are a plurality of lights, switches, meters and other I/O devices shown generally at 30 for monitoring the functioning of the apparatus and for controlling various aspects of its operation.

Handling mechanism area 28 is flanked by three mutually perpendicular chassis surfaces 32, 34 and 36. Input tray 14 is supported at its input end 38 by a pivoted arm assembly 40 and is supported at its discharge end 42 by a drive assembly 44. The tray itself is a two-part structure including a base portion 46 and a lid portion 48. The base and the lid are hingedly attached to each other by a hinge (not seen in this figure) and are releasably latched together by latches 50 and 52. Formed along the upper surface of base 46 of the input tray are twelve DIP-guiding tracks (see FIG. 3). At the input end of input tray 14, twelve LED indicators 54 are disposed over respective ends of the twelve DIP tracks to indicate whether a particular track is full or empty. A DIP magazine guiding hood 56 is disposed above the openings of the guide tracks to facilitate the positioning of the magazines in front of the tracks. At the discharge end of input tray 14, there are disposed twelve output gates 58, each associated with a respective one of the DIP-guiding tracks.

A stepping motor 60 is attached to drive assembly 44 and engages the discharge end of the input tray so as to provide the capability of driving the discharge end of the tray back and forth to align one of the twelve DIP-guiding tracks with a track leading to meter-reorienter 16. When the chosen DIP-guiding track is aligned with a track leading to the meter-reorienter, a stepper motor actuated mechanism (not seen in this figure) lifts the correct one of gates 58 to allow all of the DIPs carried by the respective guiding track to discharge and then queue in front of meter-reorienter 16. As will be further described below, the meter-reorienter both inverts and drops DIPs, one at a time, down to test head station 18.

Test head station heater assembly 62, which is carried by a pair of guide rails 64, very accurately maintains the temperature of the DIP in the test head station at a predetermined level. After the testing is done at test head station 18, the DIP is dropped down into a shuttle (not seen) which is carried along a pair of shuttle rails 65. The shuttle then releases the DIP into a predetermined one of 16 DIP-sorting tracks 66 formed in output tray 20. The output tray is also provided with four lids 68, 70, 72 and 74 of which lid 72 is partially lifted to show tracks 66.

At the discharge end of output tray 20 are 16 stops 76 and 16 output indicator lights 78. Also a two-digit, seven-segment output indicator 80 is provided. The 16 indicators will light, one at a time, to indicate to operating personnel that there are DIPs along a respective track of the output tray ready to be discharged and the two-digit indicator 80 indicates the class of DIP in that particular output track. A stop 76 prevents the DIPs along a track 66 from sliding out of the discharge end of tray 20 until a DIP magazine is positioned in front of the track to receive them.

Referring now to the side elevational view of FIG. 2, various components of the DIP handler apparatus can be seen in greater detail. Input tray 14 including the base 46 and the lid 48 are hinged on the far side (not seen) and are latched together on the near side by latches 50 and 52. The latches comprise a first C-shaped bracket 82 and a second, C-shaped bracket 84 which faces the first bracket. A tongue 86 is pivotably attached at a first end within bracket 84 and is provided with a transverse bore at a second end that a locking pin 88 may be disposed through. When the locking pin is disposed through the bore of tongue 86, base 46 and lid 48 are locked together.

Arm assembly 40 includes a support arm 90 and a pivot subassembly 92. The arm is attached to chassis 12 by pivot pin 94 which extends through an end block 96, through an elongated bore formed in a first end of arm 90 and through a second end block 98. This allows arm 90 to rotate about a first axis $A_1$.

Pivot subassembly 92 is fastened to arm 90 by a pivot pin 100 which has a first end attached to an elongated member 102 (see FIG. 1) which has a second end disposed within a bore formed in a second end of arm 90. This connection allows the subarm assembly to rotate about a second axis $A_2$.

Lastly, a pivot pin 104 disposed through an axial bore of member 102, and two mounting blocks 106 and 108 allows the subassembly to rotate about a third axis $A_3$, which in this figure extends directly out of the page. Thus, because of this combination of three axes of rotation, the discharge end of input tray 14 can move quite freely under the influence of stepping motor 60, in a manner that will be explained subsequently.

Below the discharge end of input tray 14 is a track 110 which leads to meter-reorienter 16. Stepping motor 60 drives the discharge end of input tray 14 back and forth to align a single one of the DIP-guiding tracks of the input tray with discharge track 110. When this alignment has occurred, a rotary cam 112 lifts the respective one of gates 58 to discharge the DIPs along the track. The input tray is, in part, supported by a rotary bearing 114 assembly which, like stepping motor 60, is part of drive assembly 44. Also, seen in this figure for the first time is a stepping motor 114 which drives reorienter 16 in a rotary manner, as will be discussed in much greater detail with reference to subsequent figures.

Test head station 18 includes a test head 116 and the test head station heater assembly 62. A test track 118 directs a DIP discharged from meter-reorienter 16 to the test head station. Test head station heater assembly 62 is supported by a pair of guide rails 64 including an upper rail 120 and a lower rail 122. The two rails are attached to surface 32 of the chassis by a pair of end brackets 124 and 126. The heater is attached to the track by a carriage 128 which includes a pair of rotary bearings 130 and a straight bearing formed through the carriage. The entire heater may slide back along rails 64 to allow an operator easy access to the test head at station 18, should that become necessary. After the DIP has been tested, it is carried by a track 132 to a shuttle 134. The shuttle is mounted on a carriage 136 which follows the aforementioned pair of rails 65 which includes a first rail 137 and a second rail 138. Carriage 136 has a bore formed therethrough to receive rail 137 (forming a straight bearing). The carriage is connected to rail 138 by a pair of roller bearings 140 and 142. The carriage can move along the pair of guide rails 65 in a direction parallel to both surfaces 34 and 36. The shuttle is aligned with one of tracks 66 of the output tray, as determined by the results of the tests performed at test station 18, by a mechanism to be discussed subsequently.

Output tray 20 includes an input sensor assembly 143 and output sensor assembly 144, trays 68–74, and stops 76. When shuttle 134 releases a DIP into the chosen one of tracks 66, the DIP will slide down the track until contacting a stop 76 or the last DIP along that particular track. As the DIP enters the track, sensor 143 registers that fact and relays it to the electronic computer control housed within portion 26 of the cabinet. Signals from indicator 144 are used by the computer control to monitor the discharging of the track into an awaiting magazine. The output tray is supported by a stand 146.

Figure 3:
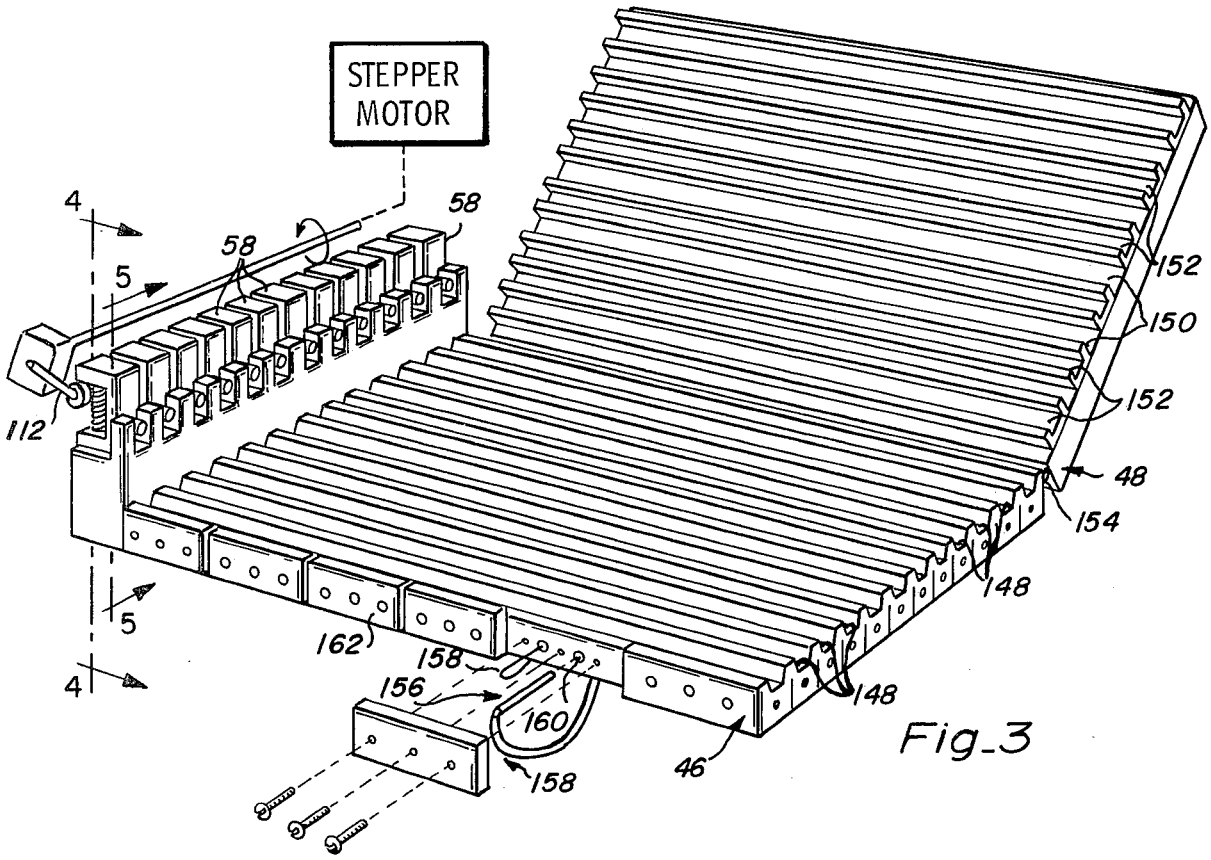
FIG. 3 is a perspective view of the input tray of the DIP handler shown in FIG. 1.

Referring now to the perspective view of an isolated input tray 14 as shown in FIG. 3, it is possible to see the twelve input tracks 148 of the tray. The DIPs are loaded onto tracks 148 in an upside down or a "dead bug" position (i.e., the "legs" of the DIPs are positioned upwardly). The side portions 150 of C-shaped channel members 152 are centered along tracks 148 to prevent the DIPs carried therealong from falling out of or jamming within the track. Base portion 46 is connected to lid 48 by a hinge 154 which can be partially seen in the right-hand portion of this figure.

The base is heated above ambient temperatures by a plurality of heater modules 156 which are connected to the computer control circuitry by wires 158. In this preferred embodiment, 20 heater modules are utilized to provide a substantially constant temperature throughout the tray.

Gates 58 are disposed, one each, in front of each of tracks 148. A stepping motor actuated cam 112 can be caused to lift a gate that it is aligned with. The alignment is accomplished by stepping motor 60, as will be discussed in greater detail with reference to FIG. 6.

Figure 4:
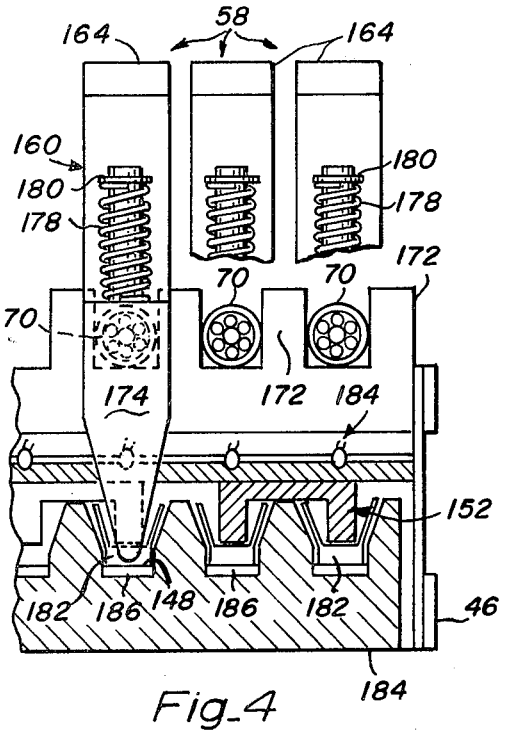
FIG. 4 is an elevational view as seen along line 4—4 of FIG. 3.
Figure 5:
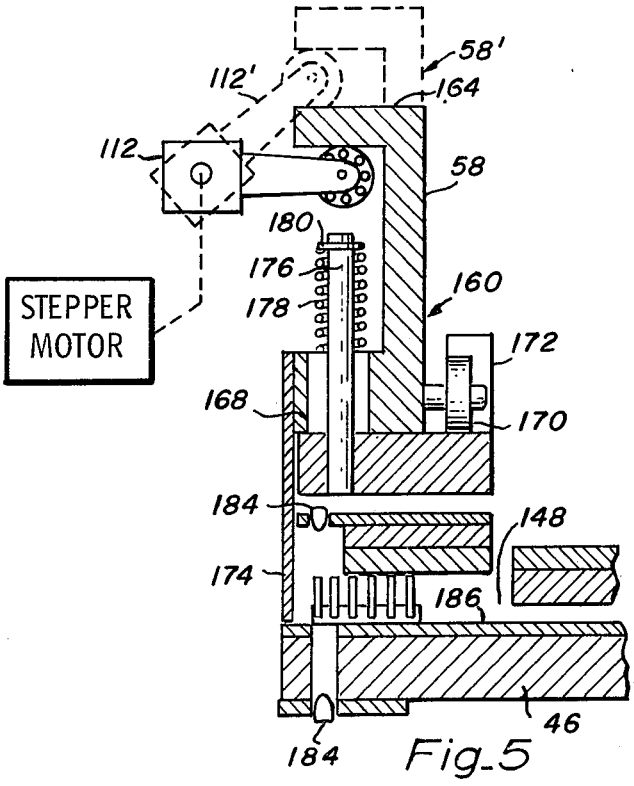
FIG. 5 is a cross section taken along line 5—5 of FIG. 3.

Referring now to FIG. 4, which is an elevational view as taken along line 4—4 of FIG. 3, and to FIG. 5, which is a cross sectional view taken along line 5—5 of FIG. 3, it may be seen that gates 58 include substantially C-shaped members 160 having upper lips 164 and lower lips 168. Attached to the rear surface members 160 are roller bearings 170 which are disposed between a pair of posts 172 that are attached to base portion 46. Attached and downwardly extending from lower lip 168 is a tongue 174 which extends in front of tracks 148. Gates 58 are resiliently attached to base 46 portion by means of spring-holding post 176, a compression spring 178 and a slip ring spring retainer 180. When stepping motor actuated rotary cam 112 is rotated into position 112', gate 58 is raised to position 58' against the pressure of spring 178. This raising of gate 58 in turn raises tongue 174 to allow a plurality of DIPs 182 to discharge from the input tray.

Also seen in this figure is a plurality of photodetector assemblies 184 associated, one each, with a track and which provide indications to the computer control as to when a DIP 182 is present or absent. Also, in this preferred embodiment, steel inserts 186 are attached to the upper surface of aluminum base portion 46 in order to provide a smooth, low friction sliding surface for the somewhat abrasive DIPs to travel along.

Figure 6:
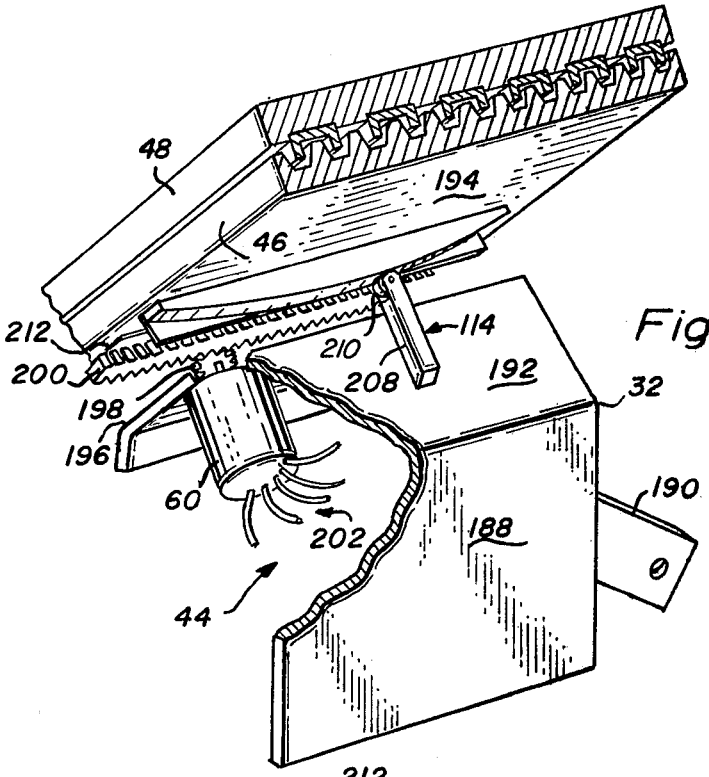
FIG. 6 is a partially broken perspective view of the input tray and its attachment to the chassis of the DIP handler shown in FIG. 1.

Referring now to FIG. 6, which is a partially broken perspective view of the input tray and drive assembly 44, particulars of the mechanism which positions the discharge end of the input tray can be seen. The drive assembly includes a support bracket 188 which is attached to surface 32 with a number of tabs 190. Bracket 188 includes a surface 192 which is substantially perpendicular to the lower surface 194 of tray 46 and a second surface 196 which is substantially parallel to surface 194. Stepping motor 60 is mounted through surface 196 so that a pinion 198 engages a rack 200 attached to the surface 194 of the tray. The weight of the tray is partially supported by this rack-and-pinion arrangement.

Stepping motor 60 has several wires 202 which are connected to the computer control electronics of the DIP handler. The computer control causes motor 60 to rotate pinion 198 in either a clockwise or a counterclockwise direction, driving the discharge end of the input tray either to the left or to the right, respectively, via a rack 200. Also supporting the tray is a ball bearing assembly 114 which contacts a bearing surface rail member 206. Member 206 has a curvalinear contact surface including a raised central portion and lowered end portions. Bearing assembly 114 includes a member 208 rigidly attached to surface 192 and a rotary bearing 210 which rides along curvalinear surface of member 206. The interaction of bearing 210 and bearing surface 206 and its relationship to the vertical positioning of the end of tray 46 will be discussed in greater detail with reference to FIGS. *7a–7c*.

Also attached to surface 194 is a tray position marking comb 212 comprising an L-shaped bracket having one leg attached to surface 194 and having a downwardly-extending leg provided with a plurality of positioning slots. A photosensitive receptor and a light source are used on opposite sides of the slotted leg of comb 212 to send a signal to the computer control electronics which then determines the position of the discharge end of the tray.

Figure 7A:
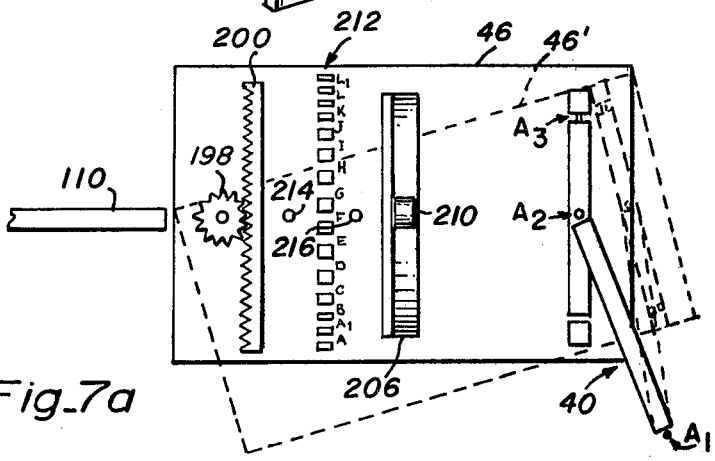
Figure 7B:
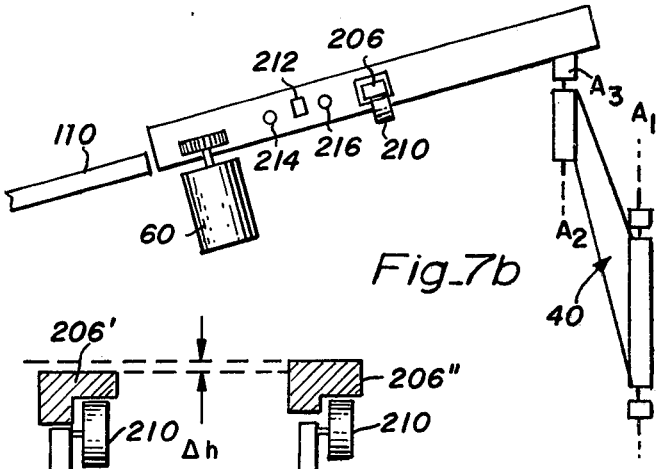

Referring now to FIGS. 7*a* and 7*b*, the interaction of the tray, support arm assembly and the drive assembly can be discussed in greater detail. In FIG. 7*a*, the solid line representation of tray 46 illustrates the position of the various aforementioned members when a central track of tray 46 is aligned with output track 110. In this position, a slot F of comb 212 is in line with a light source 214 and a photoreceptive device 216. Pinion 198 is located substantially in the center of rack 200. Bearing 210 is also located substantially in the center of member 206 and the support arm assembly 40 is positioned as shown.

When the computer control of my device decides that it is time for a different track of the input tray to be aligned with track 110, a command is given to stepping motor 60 to rotate pinion 198. (The new position of the tray is illustrated here at 46'.) As this happens, photodetector 216 detects the passages of slots G, H, I, J, K and L. The computer control within portion 26 of the chassis analyzes the number of motor steps between successive slots and discovers that the distance between slots K and L is less than that of the preceding slots. This indicates to the computer that the next slot ($L_1$) when arrived at will align the last track of the input tray with track 110. Similarly, tracks A, B, C, D, E, F, G, H, I, J and K align with the other eleven tracks of the input tray. Also notice that the support arm assembly 40 retracks backwardly as the input tray is driven from the central position at 46 to the side position at 46'. As seen in FIG. 7*b*, this would normally raise the discharge end of the input tray upwardly as shown at "X". However, since bearing 210 is riding on the curved bearing surface of member 206, this change in height is compensated for so that the discharge end of the input tray remains vertically aligned with track 110.

Figure 7C:
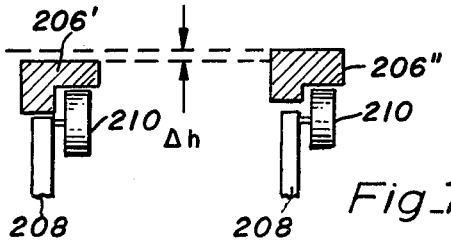

This compensating action is most clearly seen in FIG. 7*c*. On the left, bearing 210 is shown to be riding on the bearing surface of a member 206' when tray 46 is discharging one of its end tracks. On the right, bearing 210 is riding on the bearing surface of a member 206" when tray 46 is centrally aligned with discharge track 110. Note the difference of height $\Delta h$ between the two positions. This distance $\Delta h$ compensates for the raising and lowering of the discharge end of the input tray due to the movement of arm assembly 40 and thus keeps the discharge end vertically aligned with track 110.

Referring now to FIG. 8, the path of a DIP from queuing track 110 to the discharge end of the output tray 20 is illustrated. As a DIP is released from the discharge end of an input tray, it slides in "dead bug" position down track 110 and into a slot 214 of the meter-reorienter. A light-emitting device 218 emits a beam of light 220 which is reflected off a reflective surface 222 formed within member 16, and up through a pair of holes 224 and 226 to impinge upon a photosensitive device 228. When a DIP 230 slides down into slot 214, the beam 220 is interrupted to alert the computer control that a DIP is within the meter-reorienter. While in slot 214 the temperature of the DIP is maintained at a constant level by a plurality of heater modules 232.

When the computer's timing circuitry determines that it is time to release another DIP into the test head assembly 18, stepping motor 60 is caused to rotate until a photodetector pair 234 indicates to the computer control that the meter-reorienter has made a 180° revolution to cause the DIP to discharge onto track 118. The discharge of the DIP is noted by a photodetector pair 233.

After being discharged by the meter-reorienter in "live bug" disposition relative to track 118, the DIP slides down track 118 to test head station 18. There it is prevented from sliding further by a stop member 238 (shown in the dotted position at 238'). When in this position, test head 116 has a plurality of contacts (shown broken here) which engage the leads of the DIP. A pair of solenoids press the contacts of the test head against the leads of the DIP to produce an electrical connection suitable for testing.

In the meantime, the DIP is being maintained at a constant temperature by a jet of warm air flowing through slots 239, as fed by a manifold 240 formed within heater assembly 62. Manifold 240 is connected to a pressurized air supply by means of a flexible hose 242. Test head heater assembly 62 is held in position next to the test head station by means of an electromagnet 244 and a ferromagnetic plate 246. Both members 244 and 246 are electrically isolated from the cabinetry so that when they contact each other, there is a conductive path between a wire 248 and 250. The conductive path alerts the computer control to the fact that the heater assembly is in position against the test head and that the operation of the DIP handler can proceed. The electromagnet is provided with a pair of leads 262 which is connected to a power supply in order to actuate its magnetic field.

The height of stop member 238 can be adjusted by a joystick 262. As the end of joystick 262 is pushed downward in a direction labeled "A", the joystick levers against a plate 264 to move a plate 266 upwardly in a direction "A". Solenoid 254 and stop member 238 are rigidly connected to plate 266 and thus also move upwardly relative to chassis 34 to adjust the position of the DIP at test head station 18. Conversely, when the joystick is moved in a direction labeled "B", its other end is moved in a direction labeled "b" which lowers plate 266 and thus lowers the position of the DIP at the test head station. Once correctly positioned, plate 266 can be rigidly clamped in place by means of a thumb screw 270.

After the tests at test station 18 are completed, the computer control directs a solenoid 254 to withdraw a plunger 256 which causes stop member 238 to pivot around a pivot pin 258 under the influence of a spring 260 from the closed position shown in dashed lines to the open position depicted in FIG. 8. The DIP is then released and slides, under the influence of gravity, down a track 132 into shuttle 134. The passage of the DIP into shuttle 134 is detected by a photodetector pair 136.

Based upon the results of the test sequence, the shuttle 134 is moved into alignment with a particular one of the tracks of the output tray 20. When the shuttle is so positioned, the computer control commands a solenoid 272 to withdraw a plunger 274 which causes a gate-lifting arm 276 to pivot around a pivot pin 278 and lift a gate 280. The DIP then slides down, under the influence of gravity into the selected track until it is stopped by a tray stop 76 or another DIP. Entry of the DIP is detected by a photodetector pair 282 at the input end of the output tray, and the presence of the first DIP at the discharge end of the output tray is detected by a photodetector pair 284. Lid 68 can be seen in this figure to prevent the DIP from falling off or jamming a track 66.

In FIG. 9, a cross sectional view of the meter-reorienter taken along line 9—9 of FIG. 8 is shown. When DIP 286' slides down into recess 214, a second DIP 286″ is prevented from doing so. The depth of recess 214 can be adjusted by a set screw 292 so that the trailing end of a particular size of DIP 286′ is substantially flush with the outer surface of the meter-reorienter. As the meter-reorienter is rotated in a direction 288, DIP 286′ is separated (metered) from DIP 286″ and the rest of the DIPs on track 110. Thereafter, member 16 both reverses the direction that the DIP faces and also isolates the DIP from the other DIPs on the queuing track.

In FIG. 9*a*, a cross sectional view of an alternative construction for a meter-reorienter is shown to have a laterally offset recess 214′. Tracks 110′ and 118′ are likewise offset so as to align with recess 214 when it is in its loading and discharging position, respectively. The advantage of this configuration is that since the left-hand side of recess 214′ is substantially aligned with the center line of the meter-reorienter, when the meter-reorienter is rotated in a direction 288′, DIP 286″ is not pushed back up track 110.

FIG. 10 illustrates the position of meter-reorienter 16 after it has been rotated 180° to discharge a DIP 292 onto track 118. A second DIP 294 is ready to fall into recess 214 when the meter-reorienter is again in its original position. Of course, other angular relationships between the loading and the discharging position for the meter-reorienter are possible and may actually be preferable for certain alternate embodiments of the invention.

Referring now to FIG. 11*a*, the construction of the test head of the present invention can be seen. It includes an insulating base portion 296 provided with two elongated slots at 298 and 300. Disposed through each of the slots is an array of contacts 302 and 304, respectively. Each of the array of contacts comprises a double row of ten individual contacts 306 and 308, respectively. The ends of contacts 306 are bent inwardly towards the central portion of base 296 and likewise the ends of contacts 308 are bent inwardly. The row of contacts 306 and 308 are separated from each other by an insulator 310 which has a narrow flexible portion 311.

In use, a DIP is disposed between contact arrays 302 and 304 so that the legs of the DIP extend toward the base portion 206. The contact arrays are then pressed inwardly so that aligned pairs of contacts 306 and 308 redundantly contact a particular leg of the DIP. The contact arrays can then be wired to test equipment via ends 312.

In FIG. 11*b*, a solenoid assembly 314 which presses one of the contact arrays of test head 116 against the legs of DIP 316 is shown. More specifically, the solenoid assembly includes a bracket 318 to which an adjustable solenoid 320, having a plunger 322, is attached. Attached to the terminal portion of bracket 318 is a spring armature 324 which, when the plunger 322 is extended, presses contact assembly 304 against the leads of the DIP. The solenoid, which is under computer control, can also retract plunger 322 to allow spring armature 324 to attain the position shown at 324′. A solenoid assembly 326 is provided to urge the contact array 306 of the test head against the remaining leads of DIP 316.

Referring now to FIG. 12, the mechanism for driving shuttle 134 back and forth is shown. The rails 137 and 138 extend between an end bracket 327 and another end bracket 327′ which is disposed within computer control portion 26 of the chassis. Carriage 136 is attached to the rails as previously described. The driving mechanism further comprises electric motor 328, a slotted disk 330, a photosensor assembly 332, a slotted drum 334, a flexible strap 336, a flexible strap 337, and an elongated bar member 338. Disk 330 and drum 334 are attached to electric motor 328 by a shaft 340 for mutual rotation. Strap 336 has an end 342 attached within slot 344 and is then wrapped around the circumference of the drum as shown. The free end of strap 336 is attached to carriage 136. Strap 337 has an end 346 fastened within slot 334 of the drum, is wrapped thereabout as shown and then has a second end attached to rod 338 by a member 348. As drum 334 is rotated in the clockwise direction, strap 336 wraps around the drum to pull the carriage to the right along rails 137 and 138. Simultaneously, strap 337 is unwrapped from the drum due to a pulling action of member 338. Conversely, rotating drum 334 in a counterclockwise direction wraps band 337 around its circumference to cause rod 338 to push the carriage of the shuttle to the left. Simultaneously, band 336 is unwrapped from the circumference of the drum. The position of the shuttle is determined by a plurality of photodetector pairs such as photodetector pairs 332, by sensing the positional slots formed through the surface of slotted disk 328.

In FIG. 13 output tray 20 and covers 68–74 are shown in greater detail. Gate-lifting arm 276 is shown in the lifted position which allows any DIP carried by the shuttle to slide down a track 66 to a stop 76. A magazine 350 is shown loading all of the DIPs in the far end track by depressing the appropriate stop. The two-digit indicator is displaying the class of DIP being removed from the track.

Referring to FIG. 14, the cycling of the handler may be more completely discussed. The cycle actually comprises two subcycles—namely, the input subcycle and the output subcycle. The input subcycle includes all of the DIP handling up to the test head station, and the output subcycle includes all of the DIP handling after the DIP is discharged from the test head station. The cycle thus comprises two almost independent subcycles which may or may not start at the same time depending upon how the computer control is programmed.

In the input cycle, input tray indicators indicate which of the input tray tracks of input tray 14 are full and ready to be aligned with the queueing track leading to meter-reorienter 16. Input tray sensors 184 detect the presence of the DIP in the track, and gating system 58 allows the DIP to slide down past a main input sensor to the meter-reorienter. A meter-reorienter sensor 228 indicates if the DIP is within the meter-reorienter device. When sensor 228 senses a DIP, the meter-reorienter is turned one-half of a revolution to drop the DIP into position by test head 116. A test head sensor detects the entry of a DIP into the test head area. As soon as the test head sensor shows that an IC is discharged from the meter-reorienter, meter-reorienter 16 is again rotated one-half of a revolution to accept the next DIP. The DIP discharged at the test head area is stopped by a stop member 238 and test head 116 is closed to commence the testing of the IC.

When an end of testing signal is received from a tester connected to the test head, the output subcycle commences with the opening of stop member 238. This releases the DIP into shuttle 522. After the shuttle sensor indicates that the DIP is safely inside the shuttle, the shuttle moves into alignment with the appropriate track of the output tray whereafter gate 280 opens to allow the DIP to discharge into the output tray. Output tray sensor 282 senses the DIP sliding down the track.

The various sensors are also coupled to a series of indicator lights 31 (see FIG. 1) which are used to display the location at which a DIP is "jammed" during a cycle, should such an eventuality come to pass.

While this invention has been described in the light of a specific preferred embodiment, it is contemplated that after having read the preceding detailed description and after having studied the several figures of the drawing that one skilled in the art will realize various modifications and permutations thereof. For example, instead of, or in addition to the test head station a marker station could be employed to mark the DIPs with a trademark or identifying characters. Moreover, any other suitable number of input or output tracks could be included in the respective trays, etc. It is therefore intended that the following appended claims cover all such permutations and modifications as fall within the true spirit and scope of this invention.

What is claimed is:

1. A DIP-handling apparatus comprising:

input tray means having at least one input track disposed to lie in an inclined plane and for receiving DIPs at one end of said tray means in a first particular disposition relative to said track and for discharging said DIPs at the other end thereof;

test station means having a test track lying in a vertical plane intersecting said inclined plane and adapted to receive a DIP to be tested, and including test means for engaging said DIP as it is passed along said test track and for performing diagnostic tests thereupon;

metering and reorienting means disposed between said input tray means and said test station means and including a rotating member having a recess for receiving a DIP discharged from said input tray, and means for rotating said member about an axis bisecting an intersecting angle of said inclined plane and said vertical plane, said member being rotated between a DIP receiving position, wherein said recess is aligned to receive a DIP discharged from said input tray means, and a DIP discharging position, wherein said recess is aligned with said test track, whereby a DIP carried in said recess between said receiving position and said discharging position is reoriented such that the end thereof that first entered said recess at said receiving position is the last to leave the recess at said discharging position and such that the DIP is discharged onto said test track with a second particular disposition relative thereto;

output tray means having a plurality of DIP sorting tracks;

shuttle means for receiving a tested DIP discharged from said test track and for depositing it onto one of the DIP sorting tracks of said output tray means; and means responsive to a signal developed by said test means and operative to cause said shuttle means to deposit the tested DIP onto a particular one of said DIP sorting tracks.

2. A DIP-handling apparatus as recited in claim 1 wherein said input tray means includes a plurality of elongated input tracks lying parallel to each other within said inclined plane and tray positioning means for selectively positioning said input tray means such that a particular input track is aligned to discharge DIPs for input to the recess of said metering and reorienting means.

3. A DIP-handling apparatus as recited in claim 2 and further comprising:

a chassis;

means mounting said input tray means to said chassis and including a support arm for supporting the DIP-receiving end of said input tray means at a first level and having one end pivotally attached to said chassis and pivotable about a first generally vertical axis, and its other end pivotally attached to said DIP-receiving end of said input tray means and pivotable relative thereto about a second generally vertical axis, and means for supporting the other end of said input tray means at a second level lower than said first level;

and wherein said means for selectively positioning includes means for moving said other end of said input tray means laterally relative to the longitudinal dimensions of the input tracks so that a particular one of said tracks is aligned with said recess when it is in said DIP receiving position.

4. A DIP-handling apparatus as recited in claims 2 or 3 wherein said input tray means further includes gating means for selectively allowing DIPs to be discharged only from the input track having its discharging end aligned with said recess.

5. A DIP-handling apparatus as recited in claim 4 wherein said gating means includes a separate and individually actuable gate for each said input track.

6. A DIP-handling apparatus as recited in claim 5 and further comprising:

means for actuating each said gate as it is aligned with said recess.

7. A DIP-handling apparatus as recited in claim 6 wherein said recess is an elongated passageway extending into one side of said rotating member along a recess axis angularly intersecting the axis of said rotating member at an acute angle such that when said rotating member is in said DIP receiving position said recess axis is aligned with said inclined plane and when said rotating member is rotated 180° about its axis of rotation, said recess axis is aligned with said test track.

8. A DIP-handling apparatus as recited in claim 3 wherein said means for supporting said other end of said input tray means includes a roller bearing member disposed along a line generally extending between said second axis and the receiving position of said recess, and a rail member affixed to the bottom of said input tray means and having a bearing surface for engaging said roller bearing member as said other end of said input tray means is moved laterally, said bearing surface being suitably contoured to raise or lower said other end of said input tray means so as to cause the discharge end of each input track to have a predetermined elevation relative to said recess when in discharging alignment therewith.

9. A DIP-handling apparatus as recited in claim 1 or 8 wherein said metering and reorienting means further includes a queueing track disposed to lie along an inclined line extending between said input track and said rotating member and having one end thereof aligned with said recess when said recess is in said DIP-receiving position and the opposite end thereof positioned to receive DIPs discharged from said other end of said input track, wherein said test track lies along a substantially vertical line intersecting said inclined line, and wherein the axis of rotation of said rotating member lies in the plane defined by said vertical line and said inclined line and bisects the angle therebetween.

10. A DIP-handling apparatus as recited in claims 1 or 8 wherein said recess is an elongated passageway extending into one side of said rotating member along a recess axis angularly intersecting the axis of said rotating member at an acute angle such that when said rotating member is in said DIP receiving position said recess axis is aligned with said inclined plane and when said rotating member is rotated 180° about its axis of rotation, said recess axis is aligned with said test track.

11. A DIP-handling apparatus as recited in claim 10 wherein one end of said passageway is closed and means is provided in the closed end for detecting the presence of a DIP disposed therein.

12. A DIP-handling apparatus as recited in claim 1 wherein said test station means includes stop means for stopping a DIP moving along said track in a test position, and contact means disposed along said test track for engaging the leads of a DIP disposed in said test position.

13. A DIP-handling apparatus as recited in claim 12 wherein said contact means includes a plurality of contacts disposed on each side of said test track and wherein said stop means is selectively adjustable so as to enable a DIP stopped thereby to be accurately positioned relative to each said contact.

14. A DIP-handling apparatus as recited in claim 12 and further including means for applying heat to a DIP disposed in said test position.

15. A DIP-handling apparatus as recited in claim 1 wherein said shuttle means includes a DIP-receiving receptacle and means for selectively moving said DIP-receiving receptacle into alignment with a particular one of the DIP-sorting tracks of said output tray means.

16. A DIP-handling apparatus as recited in claim 15 wherein said output tray means includes indicator means for indicating when a particular sorting track is full.

17. A DIP-handling apparatus as rectied in claims 15 or 16 wherein said output tray means further includes indicator means for indicating the quality of the DIPs contained in a full track.

18. A DIP-handling apparatus as recited in claims 1, 2, 3 or 14 and further including means for applying heat to DIPs contained within said input tray means.

19. A DIP-handling apparatus as recited in claim 18 and further including means for applying heat to DIPs contained within said metering and reorienting means.

20. A DIP-handling apparatus comprising:

a chassis;

input tray means having a plurality of parallel arrayed input tracks for receiving DIPs at one end of said tray means in a first particular disposition and inverted relative to said tracks and for discharging said DIPs at the other end of said tray means;

test station means having a test track for receiving a DIP to be tested and test means for engaging said DIP as it is passed along said test track and for performing diagnostic tests thereupon;

metering and reorienting means disposed between said input tray means and said test station means and including a rotating member having a recess for receiving a DIP discharged from said input tray, and means for rotating said member between a DIP receiving position and a DIP discharging position whereby a DIP carried in said recess between said receiving position and said discharging position is reoriented such that the end thereof that first entered said recess at said receiving position is the last to leave said recess at said discharging position and such that the DIP is discharged onto said test track with a second particular disposition relative thereto;

means mounting said input tray means to said chassis and including a support arm for supporting the DIP receiving end of said input tray means at a first level and having one end pivotally attached to said chassis and pivotable about a first generally vertical axis, and its other ends pivotally attached to said DIP receiving end of said input tray means and pivotable relative thereto about a second generally vertical axis, and means for supporting the other end of said input tray means at a second level lower than said first level;

means for selectively moving said other ends of said input tray means laterally relative to the longitudinal dimensions of the input tracks so that a particular one of said tracks is aligned with said recess when it is in said DIP receiving position;

output tray means having a plurality of DIP sorting tracks;

shuttle means for receiving a tested DIP discharged from said test track and for depositing it onto one of said DIP sorting tracks; and means responsive to a signal developed by said test means and operative to cause said shuttle means to deposit the test DIP onto a particular one of said DIP sorting tracks.

* * * * *